United States Patent [19]

Tompkins

[11] 4,138,867

[45] Feb. 13, 1979

[54] HINGED HANDCUFFS AND LOCK

[76] Inventor: Harry A. Tompkins, 7201 Cottage Ave., North Bergen, N.J. 07047

[21] Appl. No.: 879,451

[22] Filed: Feb. 21, 1978

[51] Int. Cl.[2] ..... E05B 75/00

[52] U.S. Cl. ..... 70/16

[58] Field of Search ..... 70/14, 16, 17, 360, 70/361, DIG. 20

[56] References Cited

U.S. PATENT DOCUMENTS

| | | | |
|---|---|---|---|
| 2,966,787 | 1/1961 | Tompkins | 70/1 C |
| 3,618,345 | 11/1971 | Smith | 70/1 C |

FOREIGN PATENT DOCUMENTS

| | | | |
|---|---|---|---|
| 363156 | 11/1922 | Fed. Rep. of Germany | 70/1 C |
| 414936 | 8/1934 | United Kingdom | 70/1 C |

*Primary Examiner*—Robert L. Wolfe

*Attorney, Agent, or Firm*—Donald R. Heiner

[57] ABSTRACT

A set of handcuffs having two wings connected by means of a hinge wherein the hinge sections are formed directly on the wing section walls and the handcuff locking mechanism operates as a hinge pin to hold the wing sections together and as a locking device. Each wing section comprises an arcuate bow portion and a shackle portion which pivots about a pivot pin holding the two sections together and which allows the shackle portion to swing through an arc of 360°. A detent or pawl, cam operated and spring and pin biased, engages and disengages teeth formed on the shackle to alternately hold the shackle in place and allow it to swing open.

10 Claims, 12 Drawing Figures

FIG. 1
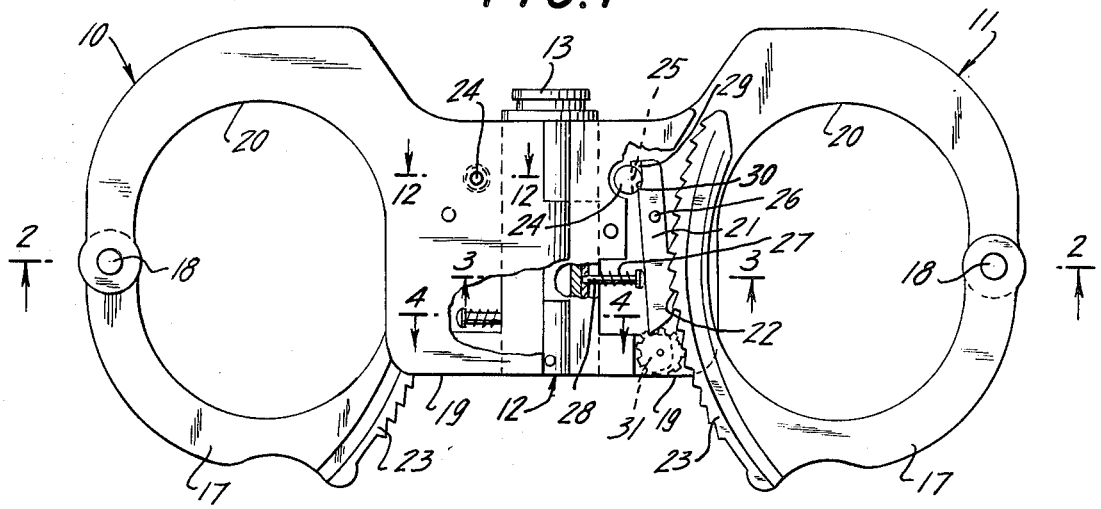
FIG. 2
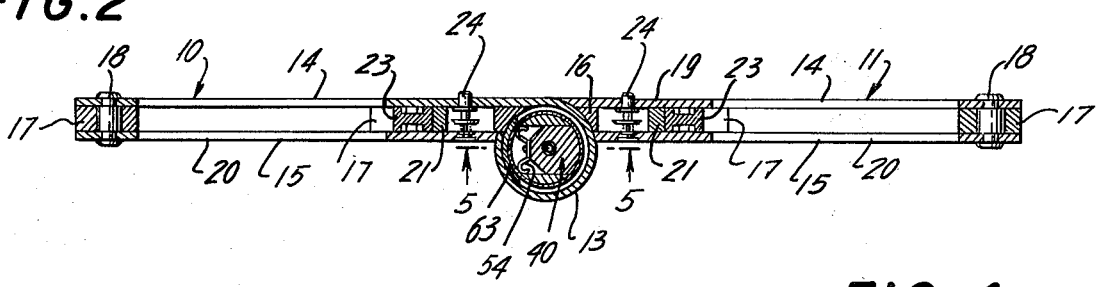
FIG. 3
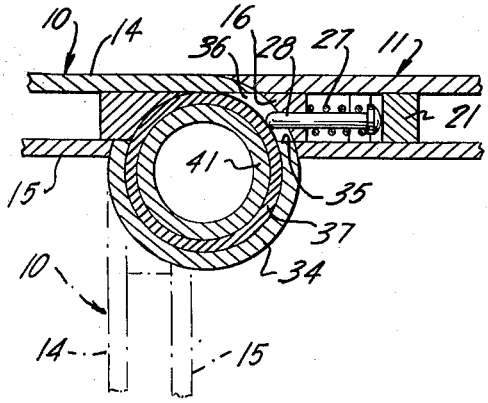
FIG. 4
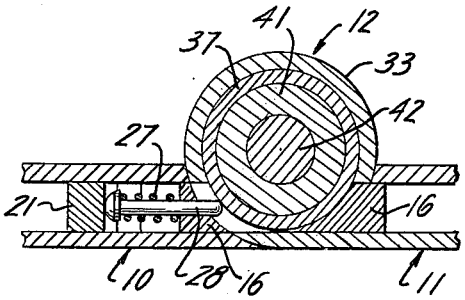
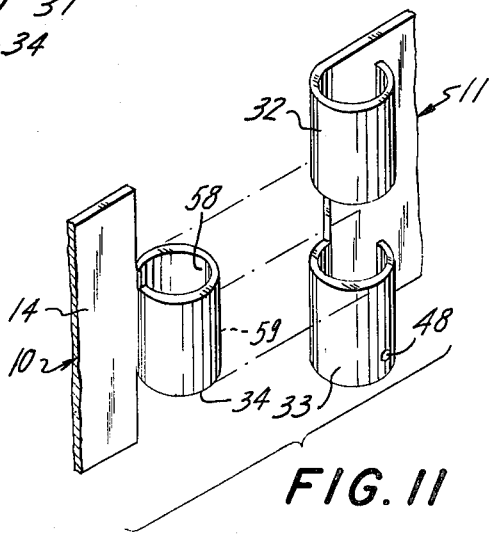
FIG. 11

FIG. 7
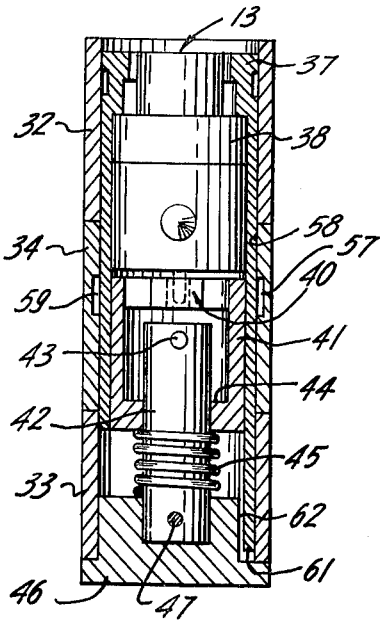
FIG. 6
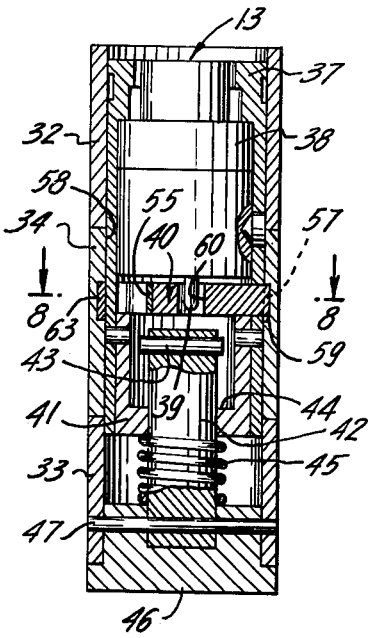
FIG. 5
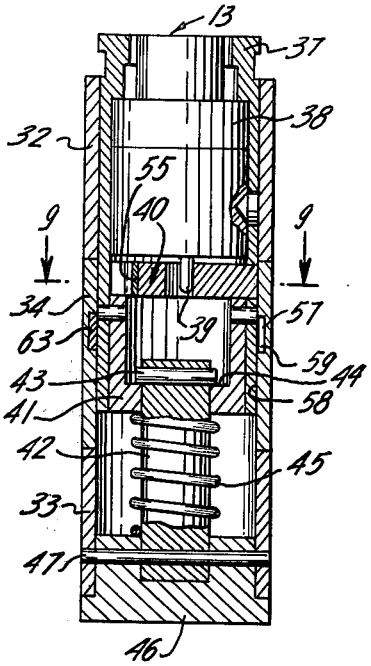
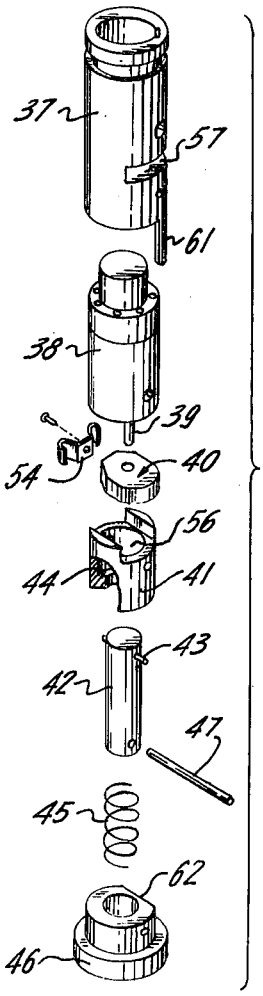
FIG. 10
FIG. 8
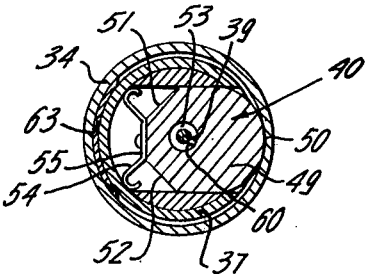
FIG. 9
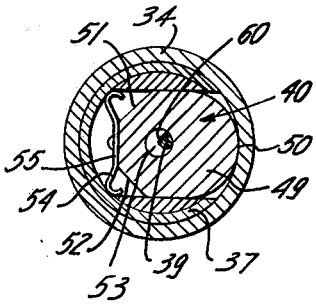
FIG. 12
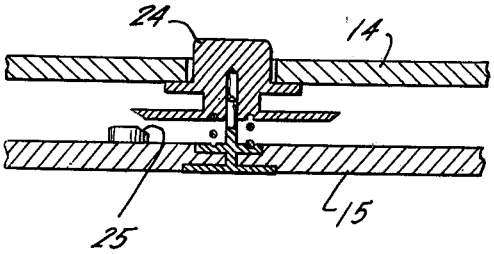

HINGED HANDCUFFS AND LOCK

BACKGROUND OF THE INVENTION

The present invention relates generally to the field of securing a prisoner or offender to an arresting officer by means of handcuffs having a locking device which functions both as a hinge pin and to block and lock individual shackles against manipulation. The invention provides a hinged handcuff which positively prevents escape of the prisoner from the locked handcuffs by outside manipulation with an instrument or tool.

This invention is an improvement over the invention claimed in U.S. Pat. No. 2,966,787 issued to the applicant herein.

The handcuffs comprise essentially two wing sections secured together by means of a hinge and hinge pin wherein the hinge pin functions as a locking mechanism. Each wing section in turn comprises essentially two parts; an acruate bow portion and a shackle portion pivotally connected to the arcuate bow portion by means of a pivot pin. The arcuate bow portion is formed by two spaced apart walls which allows the shackle portion to swing in a 360° arc. A cam operated, spring and pin biased pawl, having teeth, alternately engages and disengages teeth formed on the shackle portion to alternately hold it in place and allow it to swing. The axial position of the hinge pin-lock assembly determines whether or not the pawl is caused to be biased toward or away from the shackle teeth.

The hinge pin-lock essentially comprises a lock sleeve having a slot formed therein, and a tang depending downwardly therefrom; a tumble lock having an eccentric pin depending downwardly therefrom, a bolt operated by the eccentric pin wherein the bolt is spring biased; a stop pin assembly having a cross pin and an anchor pin; a guide support for the bolt; a compression bias spring; and, a barrel end cap plug for holding the completely assembled hinge pin-lock assembly in place inside the handcuff hinge sections.

PRIOR ART

The singular most important prior art reference in the knowledge of applicant is the patent issued to applicant Jan. 3, 1961, U.S. Pat. No. 2,966,787. This invention differs from the one disclosed in that patent in four particular areas; the locking mechanism, pawl release, the hinge, and, the shackle. The new locking mechanism adds a downwardly depending tang on the carrier sleeve 44 of the patent, eliminates pin 81 from guide support 59 of the patent, replaces items 71–74 with a spring clip, and, adds a barrel end cap for holding the hinge-pin lock in place.

The new pawl release comprises a push button, which, when pressed in, causes the button to engage a cam surface of the detent causing the detent to rotate and disengage the shackle.

The hinge sections of the patent, items 51–53, are welded to the walls of the wing sections while in the instant invention they are formed and rolled as part of the wing sections.

SUMMARY OF THE INVENTION

Briefly, the invention relates to a novel pair of double winged handcuffs wherein the locking mechanism functions both as a hinge pin to allow the two wing sections to be rotated toward and away from each other and also as a lock which blocks individual shackles against unauthorized manipulation.

The device comprises essentially two wing sections secured together by means of a hinge and hinge pin wherein the hinge pin functions as a locking mechanism. Each wing section individually comprises essentially two sections, an arcuate bow portion and a skackle portion pivotally connected to the arcuate bow portion by means of a pivot pin. Each bow portion is formed by two spaced apart walls which allows the shackle portion to swing in a full circle through the walls of the bow portion. A cam operated, spring and pin biased pawl, having teeth, alternately engages and disengages teeth formed on the shackle portion to alternately hold it in place and allow it to swing. The upward or downward position of the lock assembly determines whether or not the pawl will be allowed to be biased toward or away from the shackle teeth.

Accordingly, it is an object of this invention to provide a pair of double winged handcuffs.

Another object of the invention is to provide a pair of double winged handcuffs, hinged together, wherein the hinge sections are formed on the wings.

Another object of the invention is to provide a pair of double winged hinged handcuffs wherein the hinge pin allows the sections to be rotated toward and away from each other and which also functions as a locking device.

Another object of the invention is to provide a pair of double winged handcuffs wherein a spring loaded button having a tang cooperates with a cam surface of a pawl to force the pawl to rotate.

Another object of the invention is to provide a double winged handcuff with a novel locking device which slides axially of the handcuff hinge sections.

These and other objects and advantages of the invention are believed made clear by the following description thereof taken in conjunction with the accompanying drawings wherein;

IN THE DRAWINGS

FIG. 1 is a front elevational of the handcuffs with some parts broken away;

FIG. 2 is a sectional taken on line 2—2 of FIG. 1;

FIG. 3 is a sectional taken on line 3—3 of FIG. 1;

FIG. 4 is a sectional taken on line 4—4 of FIG. 1;

FIG. 5 is a sectional taken on line 5—5 of FIG. 2 showing the lock in its upwardly extending position;

FIG. 6 is in the same as FIG. 5 with the lock in its downward depressed position;

FIG. 7 is the same as FIG. 6 with the lock rotated 90°;

FIG. 8 is a sectional taken on line 8—8 of FIG. 6;

FIG. 9 is a sectional taken on line 9—9 of FIG. 5;

FIG. 10 is an exploded view of the lock which forms the part of this invention;

FIG. 11 is an exploded view of the hinge rings; and,

FIG. 12 a sectional taken on line 12—12 of FIG. 1 showing the spring loaded push button pawl release.

Referring now to the drawings, and briefly describing those elements which were previously described and disclosed in U.S. Pat. No. 2,966,787, issued to the applicant herein on Jan. 3, 1961, there is shown a pair of double winged hinged handcuffs comprising left and right hand wing sections 10 and 11 cooperatively held together by means of a hinge 12 and lock-pin 13. Each wing section in turn comprises two spaced apart walls 14 and 15 separated by spacer 16. A shackle 17 is operatively associated with each wing section through means of a pivot pin 18 which allows each shackle to move through an arc of 360° through the spaced apart walls of the wing sections 10 and 11. The spaced apart walls of each wing section further comprise a rectangular portion 19 and a bow portion 20 which provides support for pivot pin 18.

A detent or pawl 21 is disposed in each of the wing sections and has teeth 22 formed thereon for engagement with teeth 23 formed on shackle 17 to prevent backward or opening movement of the shackles. To disengage pawl 21 from shackle 17, to allow shackle 17 to rotate, button 24 is pushed inwardly. A cam surface 25, cooperating with button 24, moves the pawl 21 in a clockwise direction around a pivot pin 26, which supports the pawl 21, against the bias of a spring 27 disposed on pin 28. When the button is pushed inwardly a tang or cam 29 cooperates with the cam surface 30 which allows it to rotate out of engagement with teeth 23 of shackle 17. The foregoing description of the push button actuation of the pawl 21 applies only when lock-pin 13 is in its open position as shown in FIG. 5 and as will be more fully described below.

Referring now to FIG. 11, it is seen that top and botton hinge ring sections 32 and 33 are rolled sections formed as an integral portion of the right hand wing section and the middle or center hinge ring section 34 is formed as an integral portion of the left hand wing section.

Referring now to FIGS. 3 and 4, and considering the lock-pin 13 to be in an unlocked position as seen in FIG. 5, spring 27 biases pin 28 against pawl 21 and the end of the pin 28 distant from pawl 21, extends through opening 35 formed in center hinge ring section 34, where it aligns with an aperature 36 formed on a lock sleeve 37 which receives lock-pin 13. This lock sleeve 37 functions as a hinge pin and is inserted through the three hinge ring sections to fasten and hold the two wing sections 10 and 11 together in an operative fashion. With lock-pin 13 in this open position, pin 28 extends into aperture 36 and the pawl 21 is free to pivot away from the shackle by means of the push button mechanism already described. When lock-pin 13 is depressed to the locked position, aperture 36 moves to a lower level in the hinge rings, below the level of pin 28, and pin 28 engages the outer wall of lock sleeve 37 causing the pawl 21 to be spring biased against shackle 17 and held in that position by the engagement of pin 28 against the wall. In this position the pawl is positively locked against disengagement from the shackle if the push button was pressed. This blocking effect of the pin against the wall is better seen in FIG. 4.

The details of the lock-pin mechanism 13 are shown in FIGS. 5, 6, and 7, and an exploded view thereof is shown in FIG. 10. This mechanism comprises, from top to bottom in FIG. 10, a lock sleeve 37, a tumbler lock 38, an eccentric pin 39 depending from lock 38 to actuate a bolt 40, a bolt guide 41 for supporting and guiding bolt 40, a stop pin assembly 42 for limiting upward movement of guide 41 by means of a cross pin 43 engaging the bottom 44 of the bolt guide 41, a compression spring 45 to urge guide 41 upwardly, and a barrel end cap 46 which is inserted upwardly into bottom hinge ring 33 for holding the entire assembly 13 in place. Further, an anchor pin 47 is provided for insertion through the aperture 48 in bottom hinge ring 33 and through pin 42 to hold the pin in place.

Bolt 40, as best seen in FIGS. 8, 9, and 10 comprises an essentially rectangular portion 49 having a rounded end 50 and two chamfered ends 51 and 52 distant from the rounded end. An aperture 53 extends through bolt 40 for receiving eccentric pin 39 for actuating the bolt as will be further described. A spring clip 54 is operatively associated with the end 55 of the bolt distant from the rounded end and acts to bias the bolt 40 outwardly of slot 56 formed in the top of bolt guide 41, and into an opening 57 extending through lock sleeve 37 when the parts of FIG. 10 are assembled.

Referring now to FIG. 5, which shows the lock in an open or upward position, bolt 40 extends into opening 57 and engages the inner wall 58 of center hinge ring section 34. When the lock-pin 13 is pushed downwardly to its closed position, bolt 40 also is caused to move downwardly until it is adjacent an internal peripheral slot 59 formed in center hinge ring section 34 wherely bolt 40 is caused to move into engagement with slot 59 by means of the bias of spring clip 54 as best seen in FIG. 8.

When the lock-pin 13 is depressed, bolt 40 will move to the right, away from eccentric pin 39, which is then located as seen in FIGS. 6 and 8. When tumbler lock 38 is operated to the open or upward position, eccentric pin 39 moves to the left as seen in FIGS. 6 and 8 and engages the wall 60 of aperture 53 in bolt 40 and causes bolt 40 to move to the left, out of engagement with the internal peripheral slot 59 of center hinge ring section 34 and against the bias of spring clip 54. This allows the lock-pin mechanism to move upwardly by means of compression spring 45.

If the lock-pin mechanism is depressed and is not yet on the hands of a prisoner, the two wing sections 10 and 11 are swung toward each other about the hinge sections which causes bolt 40 to move out of the peripheral slot 59 as previously described and lock-pin 13 is caused to move upwardly also as previously described.

In order to prevent angular movement of the lock-pin mechanism 13, the lock sleeve 37 is provided with a downwardly depending tang 61 which cooperates with a flat surface 62 formed on the barrel end cap 46 and the inner wall of the bottom hinge ring section 33.

Therefore, when wing sections 10 and 11 are pivoted toward each other the lock-pin 13 is held fixed relative to the top and bottom hinge ring sections and center hinge ring section is free to rotate relative to lock sleeve 37.

Referring again to FIGS. 6 and 8, bolt 40 is engaging peripheral slot 59 in the center hinge ring section and an arcuate interceptor 63, having the same radial depth as slot 59, is disposed in the slot. Therefore, when wing sections 10 and 11 are rotated toward each other, bolt 40 rotates 180° and engages the interceptor, causing bolt 40 to project out of slot 59 toward the internal surface of the center hinge ring section allowing the entire lock-pin mechanism to move upwardly and the two wing sections can then be unfolded without affecting the open position of the hinge lock.

A worm gear 31 is disposed in each of the rectangular portions 19 and always engages the shackle teeth 23 to prevent an outside instrument from being inserted between the pawl teeth and shackle teeth to disengage one from the other.

Thus, what has been disclosed, is a pair of double winged, hinged handcuffs comprising a novel locking mechanism, push button operated, and further comprising a unique spring biased pawl-shackle worm gear arrangement to prevent opening of the handcuffs by an outside instrument.

It will be understood that the invention is not to be limited to the specific construction or arrangement of the parts shown and that they may be modified widely within the invention defined by the claims.

What is claimed is:

1. Hinged handcuffs and lock comprising two wing sections operatively associated with each other by means of a hinge and hinge pin wherein said hinge pin functions as a locking mechanism and wherein one wing section has a top and bottom hinge ring rolled section formed as an integral part thereof and the other wing section has a center hinge ring rolled section formed as an integral part thereof and wherein said hinge pin-locking mechanism extends through said hinge ring rolled sections to hold said wing sections together further comprising a barrel end cap inserted upwardly into said bottom hinge ring section for holding said hinge pin-locking mechanism in place and wherein said hinge pin-locking mechanism comprises:

a. a lock sleeve;
b. a tumbler lock having an eccentric pin depending therefrom;
c. a bolt accuated by said eccentric pin;
d. a bolt guide for supporting and guiding said bolt;
e. a stop pin assembly for limiting upward movement of said bolt guide by means of a cross pin engaging the bottom of said bolt guide;
f. a compression spring to urge said bolt guide upwardly and,
g. an anchor pin for insertion through an aperture formed in said bottom hinge ring section and through said stop pin assembly to hold said hinge pin-locking mechanism in place.

2. The hinged handcuffs and lock of claim 1 wherein each wing section comprises two spaced apart walls separated by a spacer and wherein each wing section has operatively associated with it, through pivot pin means, a shackle which can move through an arc to 360° and wherein each wing section further comprises a rectangular portion and a bow portion which provides support for said pivot pin.

3. The hinged handcuffs and lock of claim 2 wherein each wing section has disposed therein a pawl having teeth formed thereon for engagement with teeth formed on said shackles to prevent backward or opening movement of said shackles.

4. The hinged handcuffs and lock of claim 3 wherein each wing section had disposed therein a push button having a cam surface whereby upon pushing said button said pawl is caused to rotate about a pivot pin disposed in each wing section to cause said pawl to rotate out of engagement with said teeth formed on said shackle to allow said shackle to pivot.

5. The hinged handcuffs and lock of claim 4 wherein said pawl is biased against said shackle by means of a spring loaded pin.

6. The hinged handcuffs and lock of claim 5 wherein said bolt comprises a rectangular portion having a rounded end and two chamfered ends distant from said rounded end.

7. The hinged handcuffs and lock of claim 6 wherein an aperture extends through said bolt for receiving said eccentric pin for actuating said bolt when said tumble lock is rotated.

8. The hinged handcuffs and lock of claim 7 further comprising a spring clip operatively associated with the end of the bolt distant from said rounded end to bias said bolt outwardly of a slot formed in the top of said bolt guide and into an opening extending through said lock sleeve.

9. The hinged handcuffs and lock of claim 8 further comprising a tang downwardly depending from said back sleeve which cooperates with a flat surface formed on said barrel end cap and the inner wall of said bottom hinge ring section to prevent angular movement of said hinge pin-locking mechanism.

10. The hinged handcuffs and lock of claim 9 further comprising an arcuate interceptor disposed in an internal peripheral slot formed in said center hinge ring section whereby when said wing sections are rotated toward each other said bolt rotates 180° engages said interceptor causing said bolt to project out of said peripheral slot toward the internal surface of said center hinge ring section thereby allowing said hinge pin-locking mechanism to move upwardly and allowing said two wing sections to be unfolded.

* * * * *